US008635922B2

(12) United States Patent
Prottengeier et al.

(10) Patent No.: US 8,635,922 B2
(45) Date of Patent: Jan. 28, 2014

(54) HEIGHT-ADJUSTABLE ACTUATION DEVICE

(75) Inventors: Edgar Prottengeier, Nürnberg (DE); Ludwig Haas, Altdorf (DE); Eduard Faller, Fürth (DE)

(73) Assignee: Suspa GmbH, Altdorf (DE)

( * ) Notice: Subject to any disclaimer, the term of this patent is extended or adjusted under 35 U.S.C. 154(b) by 406 days.

(21) Appl. No.: 13/008,759

(22) Filed: Jan. 18, 2011

(65) Prior Publication Data

US 2011/0174101 A1 Jul. 21, 2011

(30) Foreign Application Priority Data

Jan. 18, 2010 (DE) ..... 10 2009 000 970

(51) Int. Cl.

| | |
|---|---|
| ***F16H 3/06*** | (2006.01) |
| ***F16H 27/02*** | (2006.01) |
| ***F16H 29/02*** | (2006.01) |
| ***F16H 29/20*** | (2006.01) |

(52) U.S. Cl.
USPC ..... 74/89.35; 74/89.23

(58) Field of Classification Search
USPC ..... 411/427, 429, 432; 74/89, 89.23, 89.34, 74/89.35, 110
See application file for complete search history.

(56) References Cited

U.S. PATENT DOCUMENTS

| | | | | |
|---|---|---|---|---|
| 4,614,128 | A * | 9/1986 | Fickler | 74/89.31 |
| 4,712,441 | A * | 12/1987 | Abraham | 74/89.38 |
| 5,508,758 | A * | 4/1996 | Marui et al. | 351/141 |
| 5,848,554 | A * | 12/1998 | Kober et al. | 74/89.35 |
| 6,145,395 | A * | 11/2000 | Swanson et al. | 74/89.33 |
| 6,349,801 | B1 * | 2/2002 | Koth et al. | 188/72.8 |
| 6,791,215 | B2 * | 9/2004 | Tesar | 310/12.24 |
| 7,044,012 | B2 * | 5/2006 | Dubus et al. | 74/89.35 |
| 7,424,833 | B2 * | 9/2008 | Fich et al. | 74/89.35 |
| 2004/0000081 | A1 | 1/2004 | Paschall | |
| 2005/0268736 | A1 * | 12/2005 | Gaechter | 74/89.23 |
| 2007/0169578 | A1 * | 7/2007 | Christensen et al. | 74/89.37 |
| 2007/0261506 | A1 * | 11/2007 | Ymker | 74/89.33 |
| 2008/0236313 | A1 * | 10/2008 | Hodnefjell et al. | 74/89.29 |
| 2008/0271552 | A1 * | 11/2008 | Arenz et al. | 74/89.23 |
| 2009/0245955 | A1 * | 10/2009 | Maillard et al. | 408/1 R |
| 2011/0174101 | A1 * | 7/2011 | Prottengeier et al. | 74/110 |

FOREIGN PATENT DOCUMENTS

| | | | |
|---|---|---|---|
| DE | 202008013317 | U1 | 12/2008 |
| FR | 699264 | A | 2/1931 |

* cited by examiner

*Primary Examiner* — Troy Chambers
*Assistant Examiner* — Alexander Vu
(74) *Attorney, Agent, or Firm* — Browdy and Neimark, PLLC

(57) ABSTRACT

A height-adjustable actuation device comprises a drive for height adjustment of the actuation device; a casing having a longitudinal axis; a hollow spindle arranged in the casing for displacement of a first lid arranged on the hollow spindle along the longitudinal axis; an internal spindle arranged inside the hollow spindle for displacement of a second lid arranged on the internal spindle along the longitudinal axis, with the hollow spindle and the internal spindle being non-rotatably connected to each other in terms of a rotation about the longitudinal axis, and with the hollow spindle and the internal spindle being displaceable relative to each other along the longitudinal axis.

17 Claims, 10 Drawing Sheets

HEIGHT-ADJUSTABLE ACTUATION DEVICE

BACKGROUND OF THE INVENTION

1. Field of the Invention

The invention relates to a height-adjustable actuation device.

2. Background Art

Actuation devices of this type are known for quite some time and are for instance used for height adjustment of large tables having in most cases heavy table tops. These actuation devices are elaborately designed and require a multitude of components some of which have a complex design. The fabrication of such actuation devices is therefore expensive.

SUMMARY OF THE INVENTION

It is an object of the invention to provide a height-adjustable actuation device having a simplified construction.

This object is achieved according to the invention by a height-adjustable actuation device, comprising a. a drive for height adjustment of the actuation device;

b. a casing having a longitudinal axis;

c. a hollow spindle arranged in the casing for displacement of a first lid arranged on the hollow spindle along the longitudinal axis;

d. an internal spindle arranged inside the hollow spindle for displacement of a second lid arranged on the internal spindle along the longitudinal axis;

e. with the hollow spindle and the internal spindle being non-rotatably connected to each other in terms of a rotation about the longitudinal axis; and f. with the hollow spindle and the internal spindle being displaceable relative to each other along the longitudinal axis.

The gist of the invention is that a hollow spindle arranged in a casing is non-rotatably connected to an internal spindle, which is arranged in said hollow spindle, with regard to a rotation about a longitudinal axis of the casing while allowing a displacement of the two spindles relative to each other along the longitudinal axis. To this end, the height-adjustable actuation device is provided with a drive. The hollow spindle may be a compound part comprising an external component and an internal component arranged at least partially inside the external component. The internal component is then a hexagonal profile pipe of metal, in particular of an aluminum alloy, while the external component is a plastic pipe which is injection-molded around the hexagonal profile pipe and comprises an external thread. In order to provide the non-rotatable connection of the hexagonal profile pipe of the hollow spindle with the internal spindle arranged therein, the internal spindle is provided with an accurately fitting hexagonal sliding element which is displaceably guided in the hexagonal profile pipe along the longitudinal axis. Another advantage of designing the hollow spindle as a compound part is the straightness of the entire spindle which, because of the hexagonal profile pipe of metal, is much better than that of a component made exclusively of plastics. Moreover, the hexagonal profile pipe does not require draft angles which a comparable component made of plastics would require, thus allowing an accurately fitting hexagonal sliding element to be guided in the component part according to the invention. An increased production accuracy of the hexagonal profile pipe can for instance be achieved by aluminum extrusion molding.

Additional features and details of the invention will become apparent from the description of two embodiments by means of the drawing.

DESCRIPTION OF THE PREFERRED EMBODIMENTS

Figure 1:
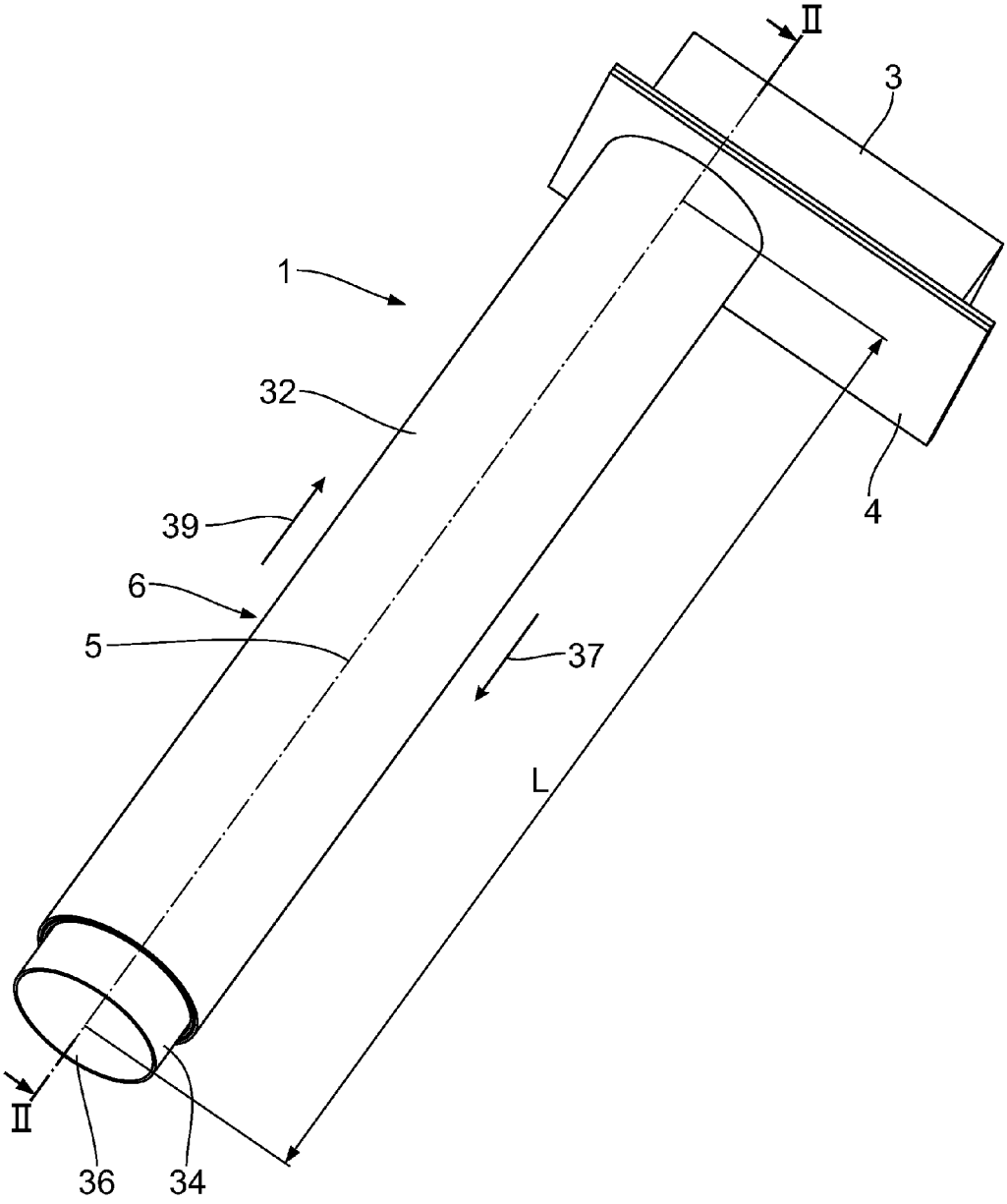
FIG. 1 is a perspective view of an actuation device according to the invention according to a first embodiment.
Figure 2:
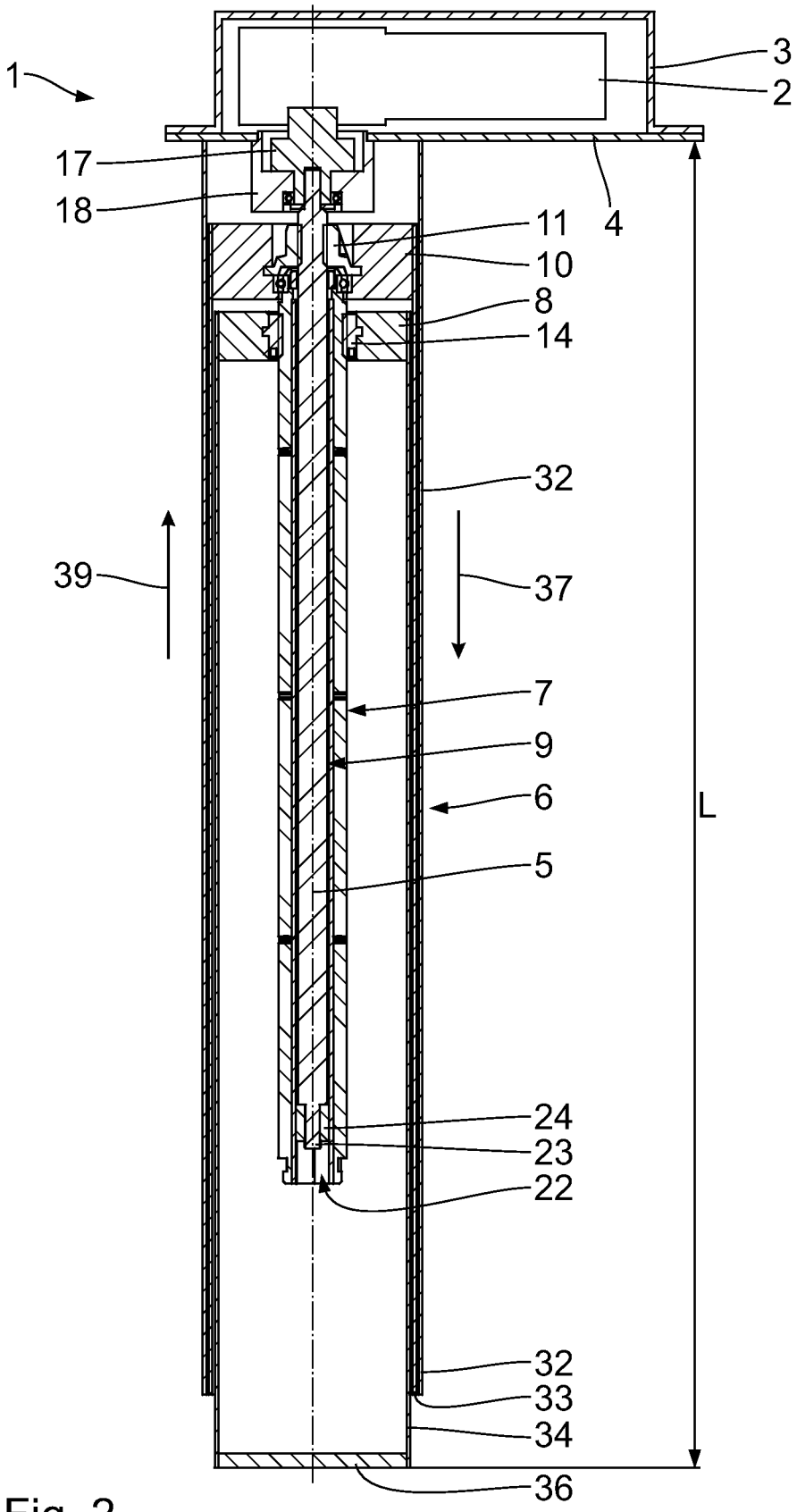
FIG. 2 is a longitudinal section along line II-II in FIG. 1.
Figure 3:
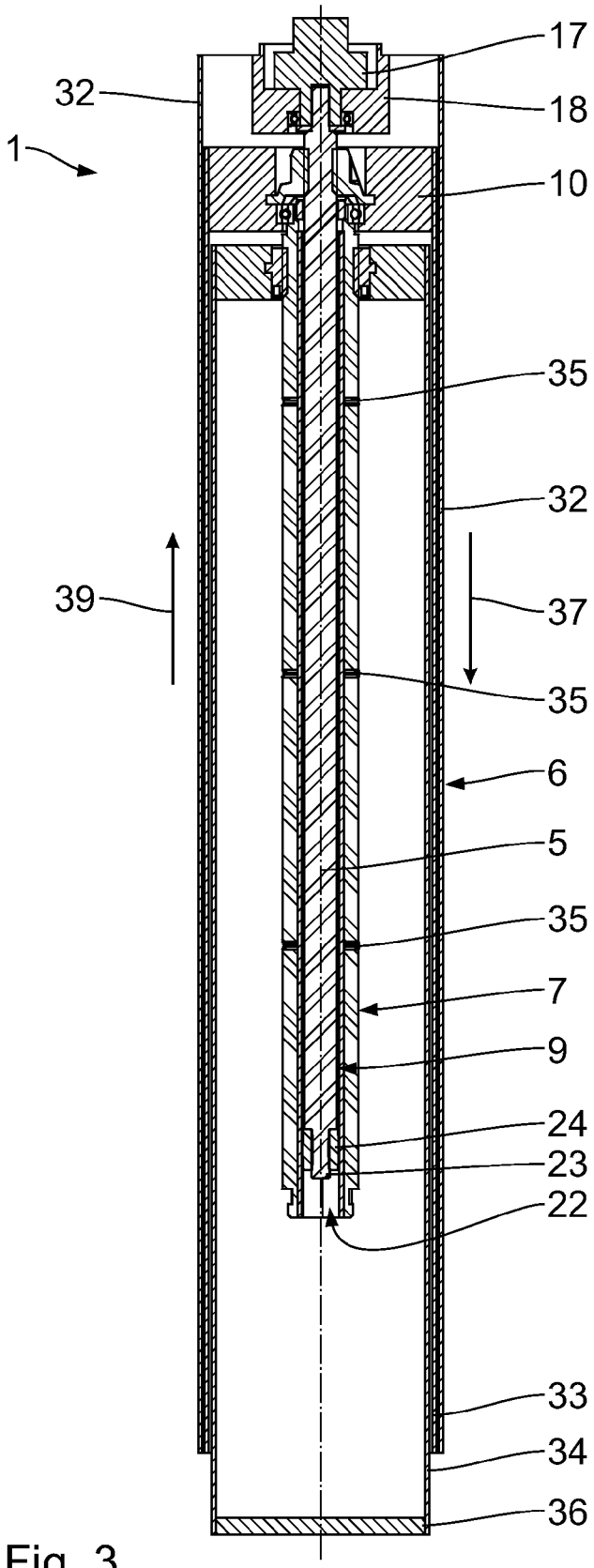
FIG. 3 is an illustration of the actuation device corresponding to FIG. 2 without illustrating the drive.
Figure 4:
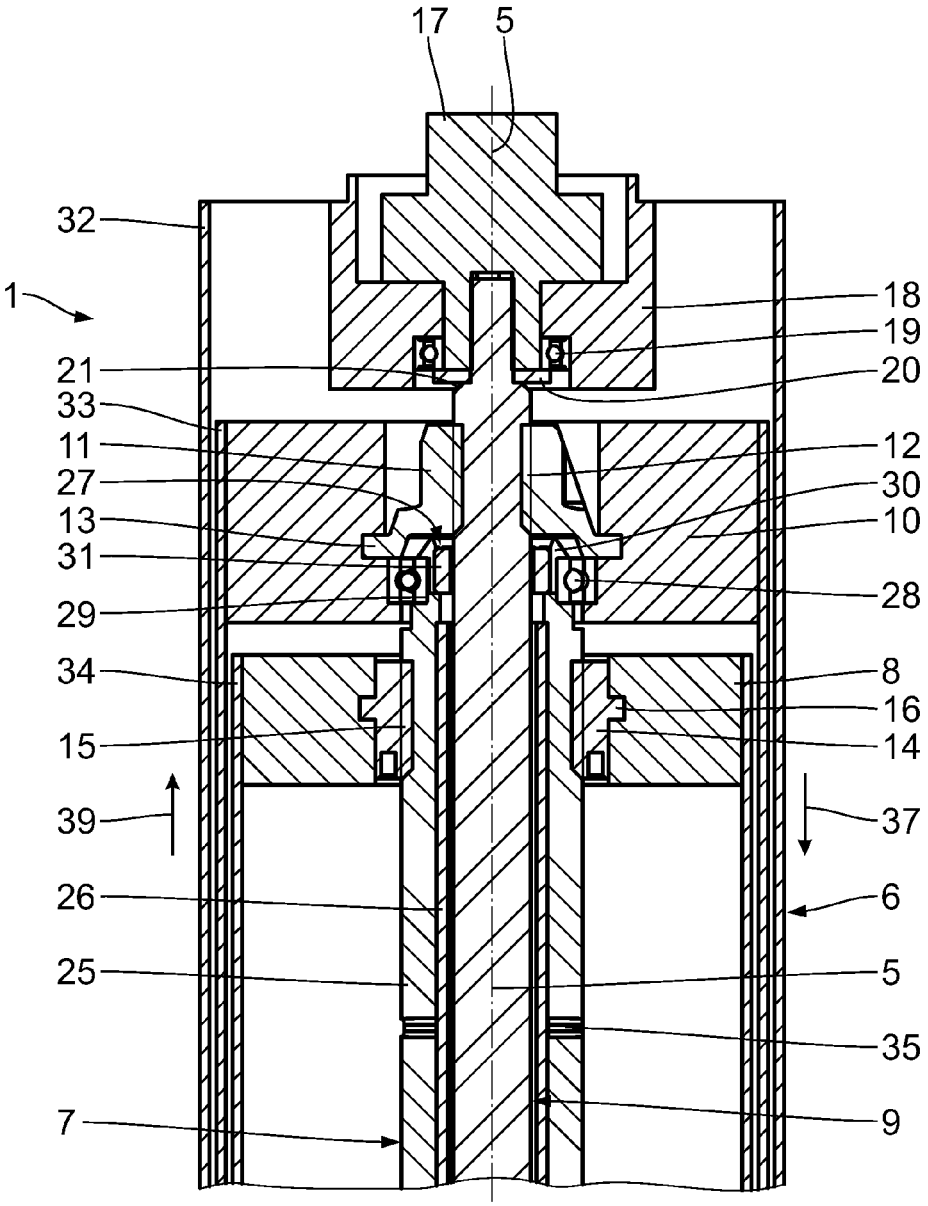
FIG. 4 is an enlarged sectional view of an upper end of the actuation device according to FIG. 3.
Figure 5:
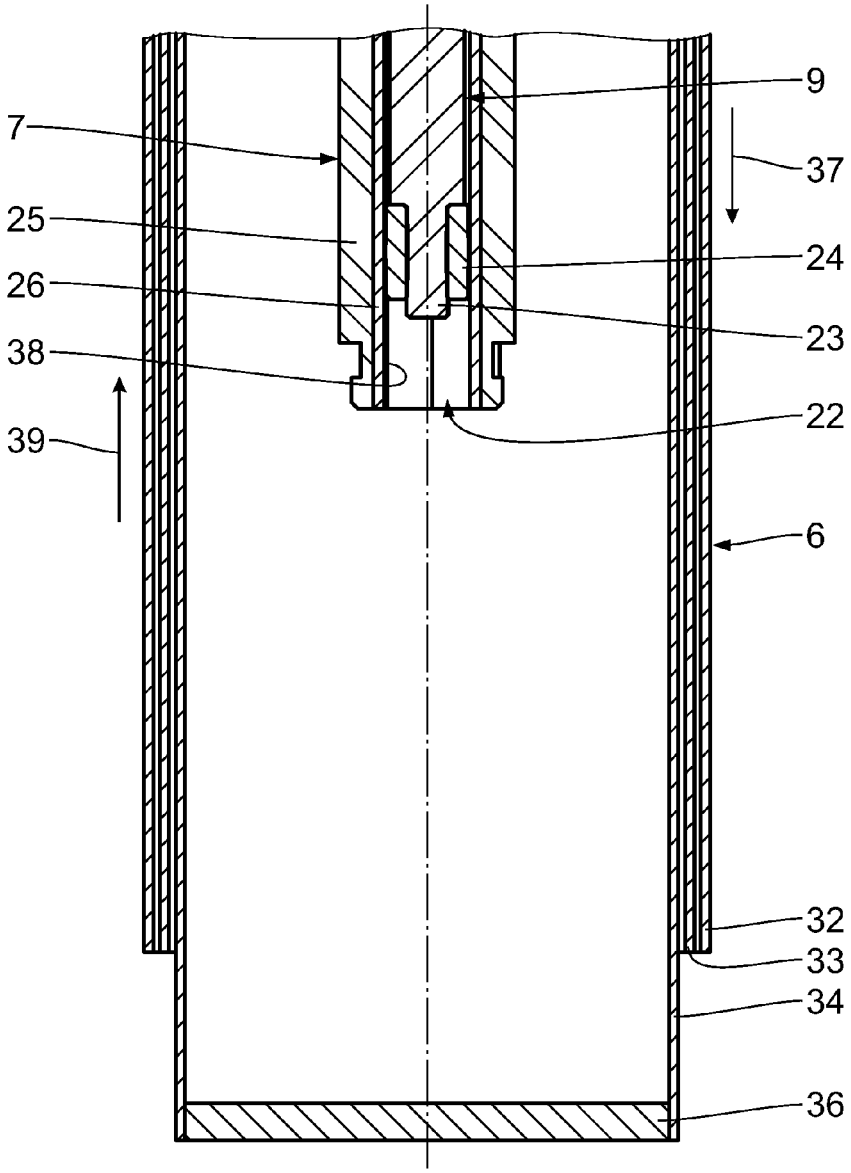
FIG. 5 is an enlarged sectional view of a lower part of the actuation device according to FIG. 3.
Figure 6:
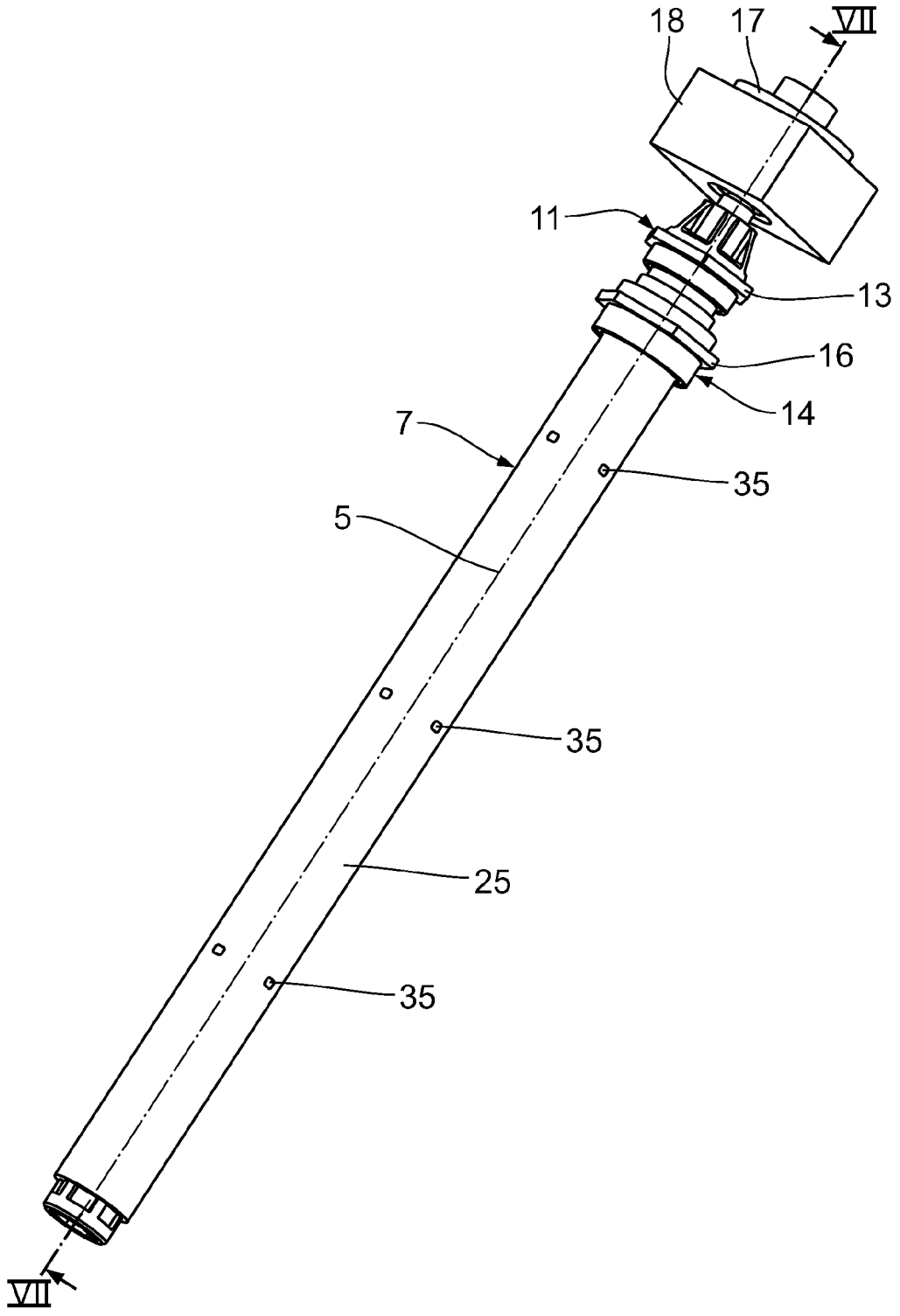
FIG. 6 is an illustration of the actuation device corresponding to FIG. 1 without casing and without drive.
Figure 7:
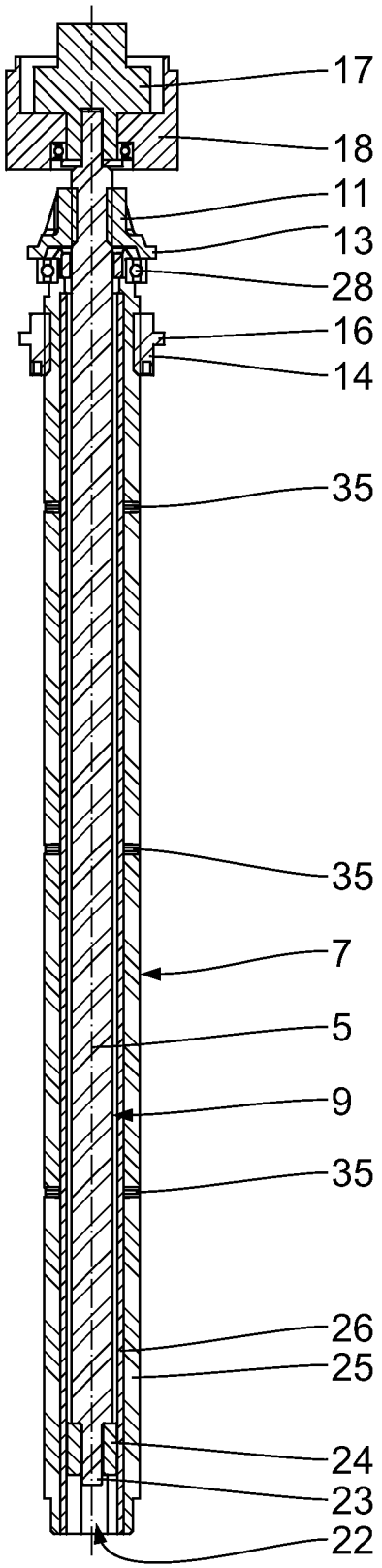
FIG. 7 is a longitudinal section along line VII-VII in FIG. 6.

A first embodiment of an actuation device 1 shown in FIGS. 1 to 7 comprises a drive 2 for height adjustment of the actuation device 1, the drive 2 being arranged in a drive casing 3. The drive casing 3 is flange-mounted to a support plate 4, with the drive casing 3 and the support plate 4 being designed such that the actuation device 1 may be completely housed for example in a table top together with the drive casing 3 while the support plate 4 closes a corresponding recess in the table top such that the drive casing 3 is not visible from outside. The support plate 4 and the drive casing 3 are rigidly but detachably connected to each other, thus ensuring accessibility of the drive 2 in the drive casing 3 for maintenance and/or repair.

On a side of the support plate 4 opposite to the drive casing 3, a casing 6 is arranged which comprises a longitudinal axis 5 and is rigidly connected to the support plate 4 by welding. It is conceivable as well to rigidly connect the casing 6 with the support plate 4 by other joining methods. The casing 6 is tubular but may also be designed as a square, rectangular, oval or differently-shaped profile pipe. In the casing 6 is arranged a hollow spindle 7 comprising a first lid 8 which is arranged on the hollow spindle 7 such as to be displaceable along the longitudinal axis 5. The first lid 8 is in the shape of an annular disk, with a first threaded bushing 14 comprising an internal thread 15 being received in a central opening, the internal thread 15 engaging into a corresponding external thread of the hollow spindle 7. On an outer circumferential surface, the first threaded bushing 14 has an undercut 16 designed in the manner of a hexagon head for axially securing said threaded bushing 14 to the first lid 8 along the longitudinal axis 5.

In the hollow spindle 7, an internal spindle 9 is arranged coaxially to the hollow spindle 7 and the casing 6. On the internal spindle 9, a second lid 10 is provided which is displaceable along the longitudinal axis 5 and which is in the shape of an annular disk as well, with a second threaded bushing 11 comprising an internal thread 12 being provided in the second lid 10 which engages into a corresponding external thread of the internal spindle 9. The second threaded bushing 11 is axially secured to internal spindle 9 along the longitudinal axis 5 by means of an undercut 13 in the shape of a hexagonal head which engages into a corresponding recess of the internal spindle 9. The lids 8, 10 are designed in two parts, thus comprising identical lid halves for mounting the threaded bushings 11, 14 to the lids 10 or 8, respectively. The design of the threaded bushings 11, 14 is shown in detail in FIG. 6.

The internal spindle 9 is connected to the drive 2 for torque transmission via a coupling element 17. This means that the internal spindle 9 is driven directly by the drive 2. The coupling element 17 is mounted for rotation about the longitudinal axis 5 in a bearing support 18 of plastics by means of a first ball bearing 19. To this end, the first ball bearing 19 is arranged in a corresponding recess of the bearing support 18 and secured against axial sliding along the longitudinal axis 5 by means of a retaining ring 20. The retaining ring 20 is axially secured by means of a shoulder 21 of the internal spindle 9. The internal spindle 9 is axially secured to the coupling element 17. Furthermore, the coupling element 17 is designed in one piece for pure torque transmission. It is conceivable as well for the coupling element 17 to have a damping function. According to a preferred embodiment not shown, the coupling element 17 is therefore designed in three pieces, comprising a coupling bottom connected to the internal spindle 9, a coupling top for connection to the drive 2, and a star-shaped damping element made of an elastomeric material. The coupling bottom, the damping element and the coupling top are arranged concentrically to the longitudinal axis 5 and are inserted into each other. Such a design of the coupling element 17 reduces occurring vibrations.

The lids 8, 10 are in each case arranged at an upper end of the spindles 7, 9 facing the drive 2 and therefore next to the drive 2.

The external threads on the internal spindle 9 on the one hand and on the hollow spindle 7 on the other have an identical pitch. It is conceivable as well for the external threads to have different pitches, with the pitch direction being equal.

At an end 22 of the internal spindle 9 opposite to the shoulder 21, the internal spindle 9 has a stub 23 on which is arranged a hexagonal sliding element 24. The hexagonal sliding element 24 is non-rotatably arranged on the stub 23 of the internal spindle 9. To this end, the hexagonal sliding element 24 has a non-round cross-section which is perpendicular to the longitudinal axis 5 and is rectangular according to the illustrated embodiment. It is conceivable as well to choose another cross-sectional shape of the stub 23, with the hexagonal sliding element 24 having a central recess corresponding thereto. The external contour of the hexagonal sliding element 24 shows a regular hexagon. The hexagonal sliding element 24 is axially secured to the stub 23, and is therefore connected to the internal spindle 9 in such a way that no axial movement can occur.

The hollow spindle 7 is a compound part comprising an external component 25 and an internal component arranged inside the external component 25. The internal component 26 is in the shape of a hexagonal profile pipe 26 of an aluminum alloy which is in particular made by extrusion molding. It is conceivable as well to make the hexagonal profile pipe 26 of another metal material. The hexagonal profile pipe 26 is designed such that the hexagonal sliding element 24 can be guided for displacement along the longitudinal axis 5, with the hollow spindle 7 providing an accurate guide for the hexagonal sliding element 24.

The external component is designed as a plastic pipe 25 in such a way that it is injection-molded around the hexagonal profile pipe 26. The plastic pipe 25 has several holes 35 along an outer circumferential surface for securing the hexagonal profile pipe 26 to the plastic pipe 25. The external thread of the hollow spindle 7 is arranged on an outer circumferential surface of the plastic pipe 25. The hollow spindle 7 is mounted, by means of a second ball bearing 28, to an upper end 27 opposite to the hexagonal sliding element 24 and opposite to the second lid 10 for rotation about the longitudinal axis 5. To this end, the upper end 27 of the plastic pipe 25 of the hollow spindle 7 is provided with a circumferential groove 29 on an outer circumferential surface for receiving the second ball bearing 28. The upper end of the plastic pipe 25 is formed by an annular latch protrusion 30 which adjoins the groove 29 in the axial direction so that the second ball bearing 28 is slidable on and latchable with the plastic pipe 25 of the hollow spindle 7 by an axial movement along the longitudinal axis 5. A radial deformation of the latch protrusion 30 is impaired by a support ring 31 arranged next to the second ball bearing 28 between an inner circumferential surface of the plastic pipe 25 and the internal spindle 9, thus ensuring that the second ball bearing 28 is locked with the plastic pipe 25.

The casing 6 is made of multiple pieces, thus comprising three casing portions 32, 33, 34 which are displaceable relative to each other along the longitudinal axis 5. The first casing portion 32 is rigidly connected to the drive casing 3, in particular by welding, and is therefore stationary. The second casing portion 33 and the third casing portion 34 are arranged inside the first casing portion 32 and are displaceable relative to the stationary first casing portion 32. The casing portions 32, 33, 34 are tubular, having an annular cross-section perpendicular to the longitudinal axis 5. The second casing portion 33 is rigidly connected to the second lid 10 and is thus displaceable together with said second lid 10 on the internal spindle 9 along the longitudinal axis 5. The third casing portion 34 is rigidly connected to the first lid 8 and is thus displaceable on the hollow spindle 7 along the longitudinal axis 5.

The first lid 8 has a smaller external diameter than the second lid 10 so that the first lid 8 with the third casing portion 34 secured thereto is arranged inside the second casing portion 33. Correspondingly, the external diameter of the second casing portion 33 is smaller than that of the stationary first casing portion 32 so that the second lid 10 with the second casing portion 33 secured thereto is arranged inside the first casing portion 32.

When the actuation device 1 is retracted as shown in FIGS. 1 to 7, the first casing portion 32 and the second casing portion 33 are designed such as to be flush at a lower end facing a support surface for the actuation device 1. The third casing portion 34 on the other hand projects downward beyond the other two casing portions 32, 33 in this illustration, thus serving as a support foot of the actuation device 1 with respect to a support surface. To this end, a bottom 36 is provided inside the third casing portion 34 which is flush with the third casing portion 34.

The following is a more detailed explanation of the functioning of the actuation device 1 for height adjustment based on the retracted position shown in FIGS. 1 to 7. For height adjustment of the actuation device 1, the drive 2 in the form of an electric motor is for instance actuated by means of a switch so that the internal spindle 9 is driven via the coupling element 17 and the bearing support 18. By rotation of the internal spindle 9 about the longitudinal axis 5 in a rotational direction of extension, the second threaded bushing 11 arranged on the internal spindle 9 is moved, via its internal thread 12, on the internal spindle 9 along the longitudinal axis 5 and away from the drive 2 in a direction of extension 37. The second lid 10, which is rigidly connected to the second threaded bushing 11, and the second casing portion 33 are displaced in the direction of extension 37 together with the second threaded bushing 11.

Due to the rotational movement of the internal spindle 9, the hexagonal sliding element 24, which is non-rotatably connected to the internal spindle 9, is rotated about the longitudinal axis 5 as well. The hexagonal sliding element 24 is then in engagement with an internal wall 38 of the hexagonal profile pipe 26 so that the driving torque transmitted to the internal spindle 9 by the drive 2 is transmitted by the internal spindle 9 to the hollow spindle 7, causing the hollow spindle 7 to rotate about the longitudinal axis 5. Due to the rotational movement of the hollow spindle 7, the first threaded bushing 14 is moved, via its internal thread 15, across the external thread of the hollow spindle 7 and away from the second lid 10 in the direction of extension 37. The displacement of the first threaded bushing 14 in the direction of extension 37 causes the first lid 8 and the third casing portion 34 mounted thereto to be moved in the direction of extension 37 and thus away from the second lid 10 as well. The identical pitches of the external threads of the hollow spindle 7 and the internal spindle 9 ensure that the displacement of the two lids 8, 10 and the casing portions 33, 34 mounted thereto takes place at the same step size.

Due to the fact that the hollow spindle 7 comprises the hexagonal profile pipe 26 in the form of an extrusion-molded aluminum profile, the hexagonal profile 26 forms an accurate guide for the hexagonal sliding element 24 for guided displacement of the hollow spindle 7 on the internal spindle 9 along the longitudinal axis 5. An extension movement of the two lids 8, 10 and the casing portions 33, 34 mounted thereto occurs in the direction of extension 37 in the region of the external threads provided on the spindles 7, 9. Starting from the retracted position in FIGS. 1 to 7, a length L of the actuation device 1 can thus virtually be tripled. When the actuation device 1 is in the extended position, the length thereof is reduced, in other words the actuation device 1 is retracted, by actuating the drive in such a way that the internal spindle 9 is rotated about the longitudinal axis 5 across the coupling element 17 and the bearing support 18 in a rotational direction of retraction opposite to the rotational direction of extension. As a consequence of the reversed rotational direction, the second lid 10 is displaced upward together with the second casing portion 33 in a direction of retraction 39 opposite to the direction of extension 37, i.e. toward the drive 2. Correspondingly, the hollow spindle 7 is also driven in the rotational direction of retraction via the hexagonal sliding element 24 in the hexagonal profile pipe 26, causing the first lid 8 with the third casing portion 34 to be displaced upward in the direction of retraction 39 as well.

Figure 8:
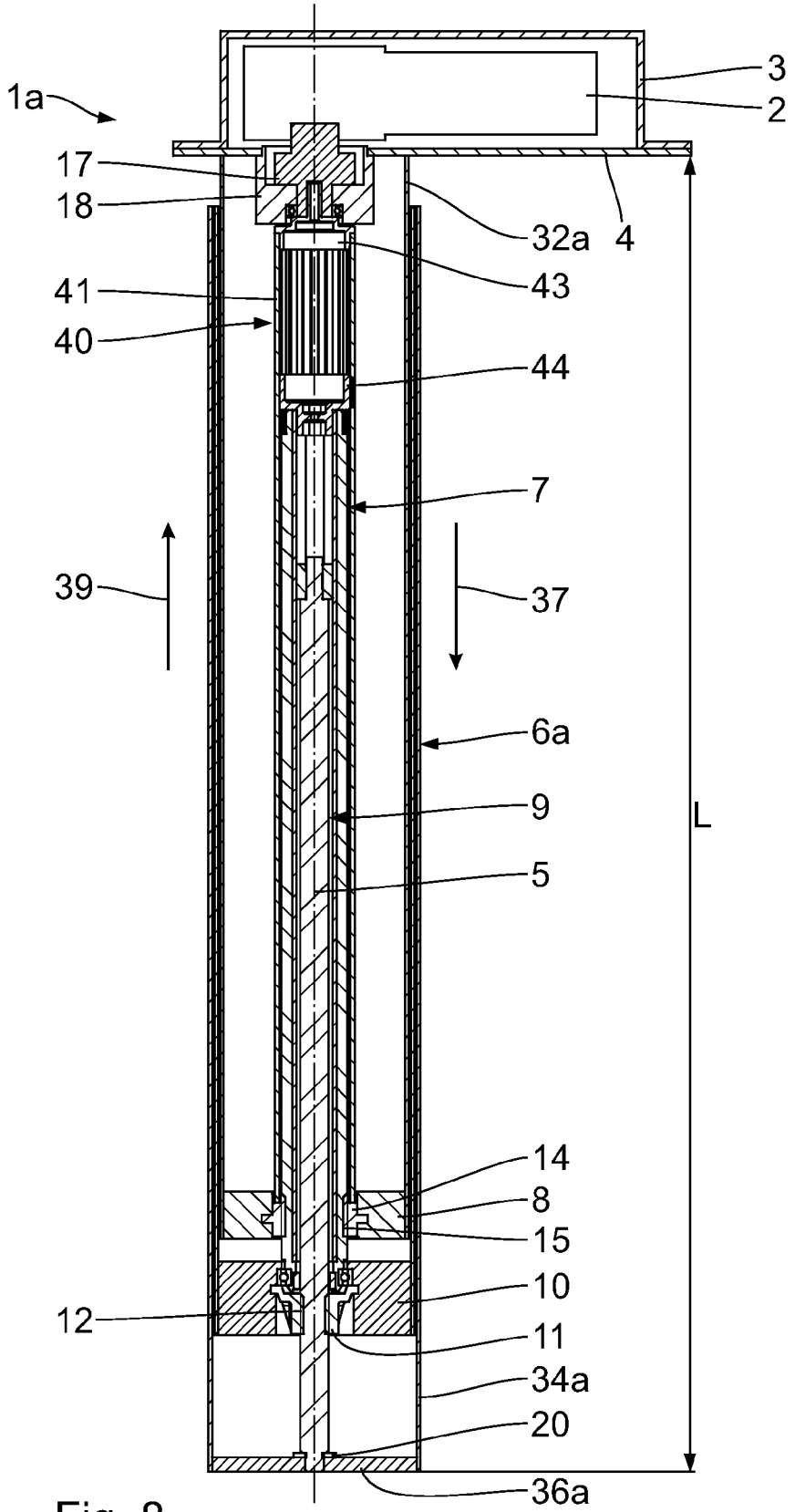
FIG. 8 is an illustration of an actuation device corresponding to FIG. 2 according to a second embodiment.
Figure 9:
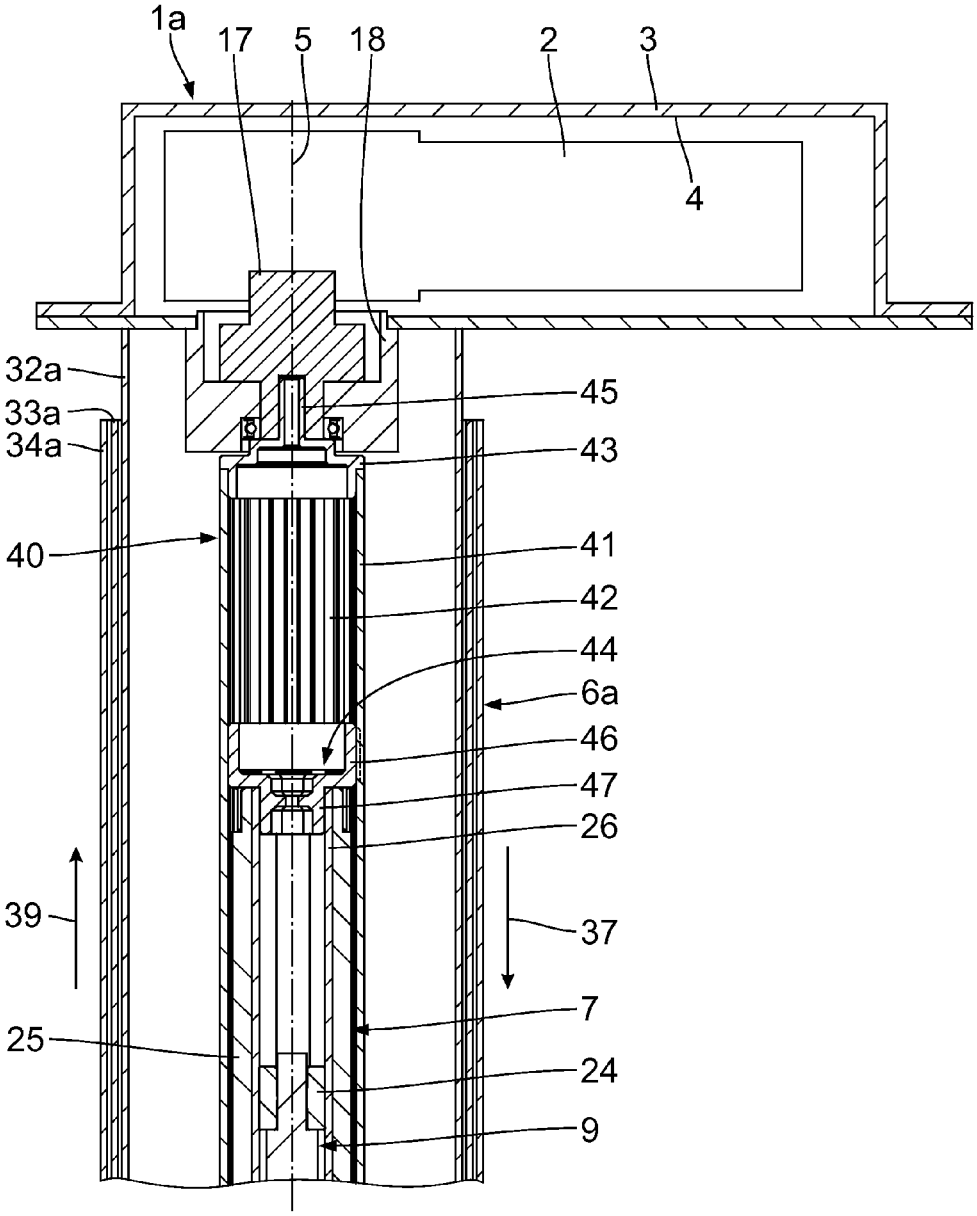
FIG. 9 is an enlarged sectional view of an upper end of the actuation device according to FIG. 8.
Figure 10:
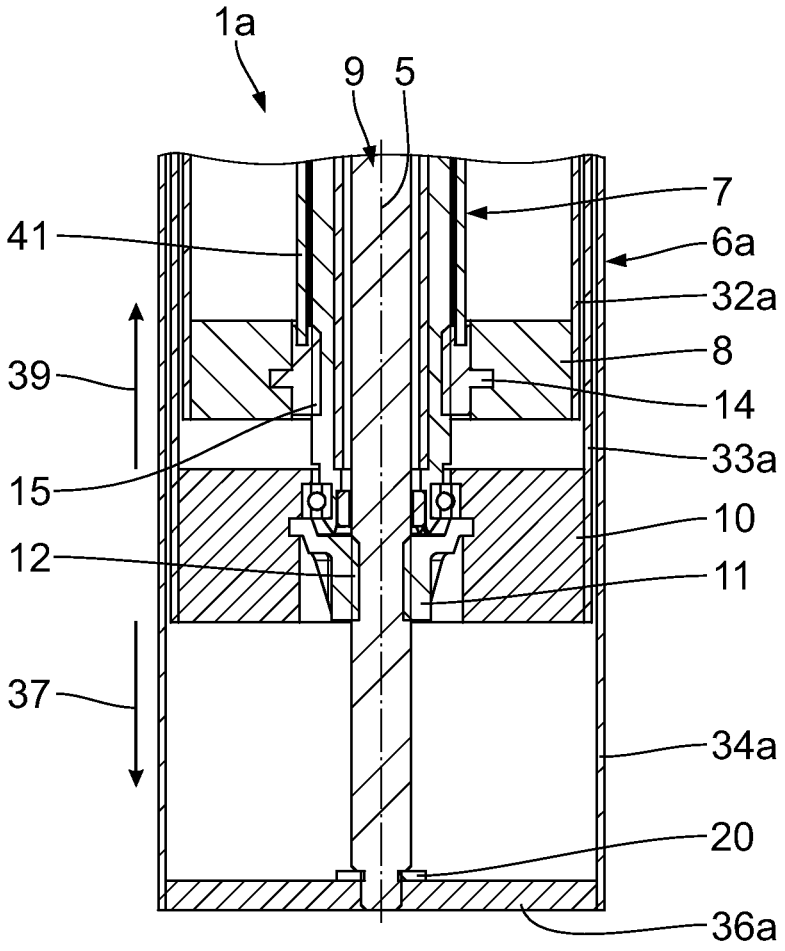
FIG. 10 is an enlarged sectional view of a lower end of the actuation device according to FIG. 8.

The following is a description of a second embodiment of the invention with reference to FIGS. 8 to 10. Identically designed parts have the same reference numerals as in the first embodiment to the description of which reference is made. Differently designed parts with the same function have the same reference numerals with a subsequent a. In contrast to the first embodiment, the hollow spindle 7 of the actuation device 1*a* according to the second embodiment is driven directly by the drive 2 via the coupling element 17 and the bearing support 18.

To this end, a connecting unit 40 is provided between the coupling element 17 and the hollow spindle 7, the connecting unit 40 comprising a profile pipe 41 with an internal profile 42, a lid 43 which is non-rotatably connected to the profile pipe 41 to which it is attached, and a profile sliding element 44 which has an external profile corresponding to the internal profile 42 such as to provide a non-rotatable connection with the profile pipe 41, the profile sliding element 44 being guided for displacement in the profile pipe 41 along the longitudinal axis 5. The spindles 7, 9 are at least partially concentrically arranged inside the profile pipe 41. A lower end of the profile pipe 41 facing away from the drive 2 is received in a corresponding groove of the first threaded bushing 14. At an end facing the drive 2, the lid 43 comprises a drive stub 45 which is arranged in a corresponding recess of the coupling element 17 for transmission of a torque from the drive 2 to the connecting unit 40. At an end facing away from the drive 2, the lid 43 is non-rotatably mounted to the profile pipe 41 for torque transmission. The profile sliding element 44 has a cylindrical main portion 46 whose outer circumferential surface is provided with the external profile for engagement with the internal profile 42 of the profile pipe 41. Along the longitudinal axis 5, the profile sliding element 44 is provided with an auxiliary portion 47 in the shape of a hexagon head which is arranged concentrically to the main portion 46 of the drive 2 and is in engagement with the hexagon profile pipe 26 of the hollow spindle 7.

In contrast to the first embodiment, the first casing portion 32*a* of the actuation device 1*a* according to the second embodiment is arranged on the inside, i.e. the second casing portion 33*a* and the third casing portion 34*a* are arranged concentrically around the first casing portion 32*a*.

Furthermore, the first lid 8 and the second lid 10 are in each case provided at the lower ends of the hollow spindle 7 or the internal spindle 9, respectively, i.e. opposite to the drive 2. Additionally, the first lid 8 is connected to the first casing portion 32*a* of the casing 6*a* which is rigidly mounted to the support plate 4. The first lid 8 and the first casing portion 32*a* are therefore stationary. The second casing portion 33*a* is mounted to the second lid 10. The third casing portion 34*a* is rigidly connected to the internal spindle 9 by means of the bottom 36*a*. The connection between the internal spindle 9 and the bottom 36*a* is axially, i.e. along the longitudinal axis 5, secured by the retaining ring 20; this connection is however not non-rotatable, with the result that the rotation of the internal spindle 9 does not cause a rotation of the bottom 36*a*.

The following is a more detailed explanation of the functioning of the actuation device 1. FIGS. 8 and 10 show the actuation device 1*a* in a retracted position which means that the length L of the actuation device la is minimal. By actuating the drive 2, a rotational movement is transmitted to the lid 43 of the connecting unit 40 via the coupling element 17 and the bearing support 18 in the rotational direction of extension 37. This causes a torque to be transmitted to the profile pipe 41, and therefore to the profile sliding element 44 engaging into the internal profile 42, about the longitudinal axis 5. The driving torque is transmitted to the hexagonal profile pipe 26 of the hollow spindle 7 by means of the auxiliary portion 47 designed in the shape of a hexagonal head element so that the hollow spindle 7 is driven directly by the drive 2. The rotational movement about the longitudinal axis 5 of the hollow spindle 7 causes a relative movement of the hollow spindle 7 and the first lid 8. The first lid 8 is rigidly connected to the support plate 4 via the first casing portion 32*a* and is therefore stationary, which causes the hollow spindle 7 to be extracted from the profile pipe 41 in the direction of extraction 37. The profile sliding element 44, which is guided for displacement along the internal profile 42 of the profile pipe 41, follows in the direction of extraction 37 of the hollow spindle 7.

Due to the rotational movement of the hollow spindle 7, the internal spindle 9 is driven in the usual manner via the hexagonal sliding element 24. Furthermore, the second lid 10 is displaced downward in the direction of extraction 37 together with the second casing portion 33*a*, which is rigidly mounted to said second lid 10, by means of the hollow spindle 7. The rotational movement of the internal spindle 9 also causes the internal spindle 9 to be moved out of the hollow spindle 7 in the direction of extraction 37 due to the engagement of the internal thread 12 of the second threaded bushing 11 with the second lid 10. This additional extracting movement of the internal spindle 9 also causes the bottom 36*a*, and therefore the third casing portion 34*a* which is rigidly mounted thereto, to be displaced downward in the direction of extraction 37.

For retracting the actuation device 1*a*, the drive 2 is actuated in such a way that the hollow spindle 7 is driven in the rotational direction of retraction 39, which is opposite to the rotational direction of extraction 37, so that the interaction of the internal threads 12, 15 of the threaded bushings 11, 14 with the external threads of the spindles 7, 9 causes the spindles 7, 9 to be displaced in the direction of retraction 39.

What is claimed is:

1. A height-adjustable actuation device, comprising:

a. a drive (2) for height adjustment of the actuation device (1; 1*a*) in a direction of extension (37) and in a direction of retraction (39) opposite to the direction of extension (37);

b. a casing (6; 6*a*) having a longitudinal axis (5);

c. a hollow spindle (7) arranged in the casing (6; 6*a*) for displacement of a first lid (8) arranged on the hollow spindle (7) along the longitudinal axis (5);

d. an internal spindle (9) arranged inside the hollow spindle (7) for displacement of a second lid (10) arranged on the internal spindle (9) along the longitudinal axis (5);

e. with the hollow spindle (7) and the internal spindle (9) being non-rotatably connected to each other in terms of a rotation about the longitudinal axis (5); and f. with the hollow spindle (7) and the internal spindle (9) being displaceable relative to each other along the longitudinal axis (5), wherein the hollow spindle (7) is a compound part comprising an external component (25) and an internal component (26) arranged inside the external component (25), and wherein the internal component is a hexagonal profile pipe (26) of metal while the external component is a plastic pipe (25) injection-molded around the hexagonal profile pipe (26).

2. The actuation device according to claim 1, wherein the internal component is a hexagonal profile pipe (26) of an aluminum alloy.

3. The actuation device according to claim 2, wherein the hexagonal profile pipe (26) is made by extrusion molding for providing an accurate guidance for a hexagonal sliding element (24).

4. The actuation device according to claim 1, comprising a hexagonal sliding element (24) for non-rotatably connecting the internal spindle (9) to the hollow spindle (7).

5. The actuation device according to claim 4, wherein in order to achieve the non-rotational connection, the hexagonal sliding element (24) interacts with the hexagonal profile pipe (26) of the hollow spindle (7) and is guided in the hexagonal profile pipe (26) for displacement along the longitudinal axis (5).

6. The actuation device according to claim 1, wherein the drive (2) drives one of the group comprising the hollow spindle (7) and the internal spindle (9) directly via a coupling element (17).

7. The actuation device according to claim 1, wherein the casing (6; 6*a*) has a multi-part design comprising housing portions (32, 33, 34; 32*a*, 33*a*, 34*a*) which are displaceable relative to each other.

8. The actuation device according to claim 7, comprising a design of the housing portions (32, 33, 34; 32*a*, 33*a*, 34*a*) such that the spindles (7, 9) are arranged inside the casing (6; 6*a*).

9. The actuation device according to claim 1, comprising a connecting unit (40) for non-rotatably connecting the drive (2) to the hollow spindle (7).

10. The actuation device according to claim 9, wherein the connecting unit (40) comprises a profile pipe (41) with an internal profile (42) and a profile sliding element (44) with an external profile corresponding to the internal profile (42).

11. The actuation device according to claim 1, wherein the external component (25) has several holes (35) along an outer circumferential surface for securing the internal component (26) to the external component (25).

12. The actuation device according to claim 11, wherein the holes (35) are oriented radially regarding the longitudinal axis (5).

13. A height-adjustable actuation device, comprising:

a. a drive (2) for height adjustment of the actuation device (1; 1*a*) in a direction of extension (37) and in a direction of retraction (39) opposite to the direction of extension (37);

b. a casing (6; 6*a*) having a longitudinal axis (5);

c. a hollow spindle (7) arranged in the casing (6; 6*a*) for displacement of a first lid (8) arranged on the hollow spindle (7) along the longitudinal axis (5);

d. an internal spindle (9) arranged inside the hollow spindle (7) for displacement of a second lid (10) arranged on the internal spindle (9) along the longitudinal axis (5);

e. with the hollow spindle (7) and the internal spindle (9) being non-rotatably connected to each other in terms of a rotation about the longitudinal axis (5); and f. with the hollow spindle (7) and the internal spindle (9) being displaceable relative to each other along the longitudinal axis (5), wherein the first lid (8) comprises an internal thread (15) engaging into a corresponding external thread of the hollow spindle (7) causing the first lid (8) to be moved relative to the second lid (10), wherein the second lid (10) comprises an internal thread (12) engaging into a corresponding external thread of the internal spindle (9) causing the second lid (10) to be moved relative to the drive (2), wherein the first lid (8) is in the shape of an annular disk comprising a central opening, said opening receiving a first threaded bushing (14) comprising said internal thread (15), wherein the first threaded bushing (14) has an undercut (16) in the shape of a hexagon head for axially securing said thread bushing (14) to the first lid (8) along the longitudinal axis (5).

14. The actuation device according to claim 13, wherein the second lid (10) is in the shape of an annular disk with a second threaded bushing (11) comprising said internal thread (12).

15. The actuation device according to claim 13, wherein at least one of the group of the first lid (8) and the second lid (10) comprises two parts for mounting a threaded bushing (11, 14).

16. The actuation device according to claim 15, wherein the two parts are identical lid halves.

17. A height-adjustable actuation device, comprising:

a. a drive (2) for height adjustment of the actuation device (1; 1*a*) in a direction of extension (37) and in a direction of retraction (39) opposite to the direction of extension (37);

b. a casing (6; 6*a*) having a longitudinal axis (5);

c. a hollow spindle (7) arranged in the casing (6; 6*a*) for displacement of a first lid (8) arranged on the hollow spindle (7) along the longitudinal axis (5);

d. an internal spindle (9) arranged inside the hollow spindle (7) for displacement of a second lid (10) arranged on the internal spindle (9) along the longitudinal axis (5);

e. with the hollow spindle (7) and the internal spindle (9) being non-rotatably connected to each other in terms of a rotation about the longitudinal axis (5); and f. with the hollow spindle (7) and the internal spindle (9) being displaceable relative to each other along the longitudinal axis (5), wherein the first lid (8) comprises an internal thread (15) engaging into a corresponding external thread of the hollow spindle (7) causing the first lid (8) to be moved relative to the second lid (10), wherein the second lid (10) comprises an internal thread (12) engaging into a corresponding external thread of the internal spindle (9) causing the second lid (10) to be moved relative to the drive (2), wherein the first lid (8) is in the shape of an annular disk comprising a central opening, said opening receiving a first threaded bushing (14) comprising said internal thread (15), wherein the second threaded bushing (11) is axially secured to the internal spindle (9) along the longitudinal axis (5) by means of an undercut (13) in the shape of a hexagonal head, which engages into a corresponding recess of the internal spindle (9).

* * * * *

UNITED STATES PATENT AND TRADEMARK OFFICE

CERTIFICATE OF CORRECTION

PATENT NO. : 8,635,922 B2
APPLICATION NO. : 13/008759
DATED : January 28, 2014
INVENTOR(S) : Edgar Prottengeier et al.

It is certified that error appears in the above-identified patent and that said Letters Patent is hereby corrected as shown below:

Title Page at Item (30) Foreign Application Priority Data, delete "(DE) 10 2009 000 970", and insert --"(DE) 10 2010 000 970--

Signed and Sealed this
First Day of July, 2014

Michelle K. Lee

Michelle K. Lee
*Deputy Director of the United States Patent and Trademark Office*